United States Patent [19]

Ando

[11] 4,358,681

[45] Nov. 9, 1982

[54] CORONA DISCHARGER

[75] Inventor: Yujiro Ando, Yokohama, Japan

[73] Assignee: Canon Kabushiki Kaisha, Tokyo, Japan

[21] Appl. No.: 187,005

[22] Filed: Sep. 15, 1980

Related U.S. Application Data

[63] Continuation of Ser. No. 27,726, Apr. 6, 1979, abandoned.

[30] Foreign Application Priority Data

Apr. 14, 1978 [JP] Japan ..... 53/43993
Dec. 8, 1978 [JP] Japan ..... 53/151774

[51] Int. Cl.[3] ..... H01T 19/04
[52] U.S. Cl. ..... 250/324; 250/325
[58] Field of Search ..... 250/324, 325, 326; 361/229, 230; 355/3 CH

[56] References Cited

U.S. PATENT DOCUMENTS

| | | | |
|---|---|---|---|
| 2,777,957 | 1/1957 | Walkup | 250/325 |
| 3,778,622 | 12/1973 | Kobayashi et al. | 250/324 |
| 3,797,927 | 3/1974 | Takahashi et al. | 250/325 |
| 3,942,006 | 3/1976 | Hayne | 250/326 |
| 3,978,379 | 8/1976 | De Vecchio | 355/3 CH |
| 4,265,998 | 5/1981 | Barkley | 250/325 |

*Primary Examiner*—Bruce C. Anderson
*Attorney, Agent, or Firm*—Fitzpatrick, Cella, Harper & Scinto

[57] ABSTRACT

This specification discloses a method of making the grid of a corona discharger device and a method of mounting the corona discharger device on an apparatus body, and more particularly a method of easily forming a number of grids and a method of mounting a corona discharger device having such grids on an apparatus body. The grid making method of the present invention comprises winding an electrically conductive thin wire on a rotatable body, fixing the wound thin wire in the direction of the rotational axis of the rotatable body, fixing the wound thin wire in the direction of the rotational axis of the rotatable body by means of fixing members, and cutting the thin wire in the direction of the rotational axis. The method of mounting a corona discharger having a number of grids with respect to an apparatus body enables the grids to be highly accurately mounted with respect to the surface of an electrically charged member by using the surface of a grid supporting member which faces the charged member as the standard surface for determining the distance between the surface of the charged member and the surface of the grid supporting member.

22 Claims, 7 Drawing Figures

CORONA DISCHARGER

This is a continuation of application Ser. No. 27,726, filed Apr. 6, 1979, abandoned.

BACKGROUND OF THE INVENTION

1. Field of the Invention

This invention relates to the grid of a corona discharger in an image formation apparatus, and more particularly to a control grid comprising a number of metal thin wires uniformly stretched with respect to a corona discharge electrode and to a method of forming the same. The invention further relates to a method of mounting a corona discharger device so that the above-described control grid is at a proper interval with respect to an image-bearing member in an image formation apparatus.

2. Description of the Prior Art

Chargers or dischargers utilizing corona discharge have been used in image formation apparatus such as electrophotographic copying machines, electrophotographic recording apparatus and the like. Such a corona discharger has its quantity of charge (discharge) greatly affected and varied by environmental conditions such as humidity and the like and therefore, a corona discharger provided with a control grid (hereinafter referred to as the grid) is often used to charge (discharge) to a predetermined potential. In this case, to enhance the control effect of the charging or discharging potential, it is required to narrow the grid interval. Such corona discharger, as described in Japanese Open Patent Application No. 77/76036 (corresponding to U.S. Ser. No. 750,568, is often used to uniformly discharge the surface of a photosensitive medium to 0 potential.

FIG. 1 of the accompanying drawings show, in exploded perspective view, a corona discharger having such a conventional grid. In the Figure, the corona discharger 1 comprises a shield plate 2, discharge wire supporting members 3 integral with the shield plate, a corona discharge wire 4 stretched between the supporting members, and a grid unit 5. In the grid unit 5, metal thin wires are alternately hooked to pins $7_1$ and $7_2$ provided on support members $6_1$ and $6_2$ and the thin wires are stretched between the members $6_1$ and $6_2$ to thereby form a grid 8. Heretofore, when a number of grids with narrowed intervals are to be stretched by the use of such a method of formation, the stretching has been very difficult. In addition, irregularities have been often caused to the interval between the individual thin wires of the grid and to the tension (tensioned state) of the thin wires and it has been difficult to obtain a practical grid. Further, if one of the thin wires is broken by some cause or other, all the other thin wires become loosened or deviated and this has led to an inconvenience that the grid must be re-stretched from the first.

There is also an example of the grid which uses a reticulately woven metal net or a metal plate provided with a number of openings, but in such grid it is more difficult to accurately set up the intervals between the grid openings than in the case of metal thin wires and particularly, when a drum-shaped photosensitive medium is employed, it is difficult to accurately hold the grid cylindrically along the drum surface. Moreover, dust tends to clog the interior of the openings, thus making it difficult to clean the same. Further, to cause the non-uniform potential on the surface of the image-bearing member to be uniformly converged to a predetermined value by the above-described control grid, the interval $d_1$ between the control grids and the interval $d_2$ between the control grids and the surface of the image-bearing member become important problems. This is because the charging (discharging) speed and the final surface potential become varied by the ratio between the two intervals, $d_1/d_2$.

As regards the former of the intervals $d_1$ and $d_2$, it can be considerably accurately set up according to the method as shown in FIGS. 1 and 2. But however accurately the interval $d_1$ may be set up, it will be difficult to ensure the surface of the image-bearing member to be converged to a predetermined potential, namely, to ensure proper image formation, if the interval $d_2$ is varied each time the corona discharger device is dismounted with respect to the image formation apparatus for the cleaning of the control grid.

A method of mounting a corona discharger device into an image formation apparatus by inserting the same along a guide rail or by engaging pins with pin holes is heretofore known, but in any of these cases it has been difficult to obtain a high distance accuracy between the control grid and the image-bearing member because of the backlash of the guide rail and the mounting error of the pins in the pin holes.

SUMMARY OF THE INVENTION

In view of the above-noted disadvantages, it is an object of the present invention to provide a control grid of a corona discharger which can be easily and accurately stretched and which can be simply cleaned. It is another object of the present invention to provide a method of mounting a corona discharger device which enables easy obtainment of high distance accuracy between the control grid and the image-bearing member by a simple construction.

The control grid may be stained by residual toner on the surface of the image-bearing member or by dust and harmful substances created by corona discharge and may fail to effect discharge uniformly, thus causing irregularity to the surface potential of the image-bearing member.

It is therefore another object of the present invention to provide a novel cleaning device for the grid.

The invention which achieves the above-noted objects consists in a corona discharger in a method of forming the control grid of the corona discharger in an image formation apparatus which comprises winding an electrically conductive thin wire at predetermined intervals on a pillar-like winding member, fixing the wound electrically conductive thin wire in a direction perpendicular to the direction of winding of the thin wire by means of fixing members, and then cutting the electrically conductive thin wire along the direction in which said fixing members are mounted, thereby forming the grid. A member for stretching and holding the above-described control grid is provided with a positioning surface and such positioning surface is caused to bear against a discharger receiving member provided in the image formation apparatus, thereby ensuring a constant interval between the control grid and the image-bearing member.

The invention will become more fully apparent from the following detailed description thereof taken in conjunction with the accompanying drawings.

DESCRIPTION OF THE PREFERRED EMBODIMENTS

The invention which achieves the above-described objects consists in a control grid of a corona discharger in an image formation apparatus, which grid comprises fixing members formed of rubber, resin or plate-like members for stretching grid thin wires, and a number of electrically conductive thin wires stretched at predetermined intervals between the fixing members. In the formation of such control grid, an electrically conductive thin wire is wound at predetermined intervals on a pillar-like winding member such as circular cylinder, square pillar or frame-like member, the wound thin wire is fixed by the fixing members in a direction perpendicular to the winding direction, whereafter the electrically conductive thin wire is cut along the mounting direction of the fixing members to thereby form the control grid. Therefore, according to such a formation method, the stretching of the electrically conductive thin wire becomes very easy and a grid with high accuracy can be obtained. The control grid so formed does not offer an inconvenience that all the thin wires must be replaced even if only one thin wire is broken, and the control grid can be easily cleaned by removing it from the corona discharger.

The invention will hereinafter be described by reference to the accompanying drawings.

Figure 2:
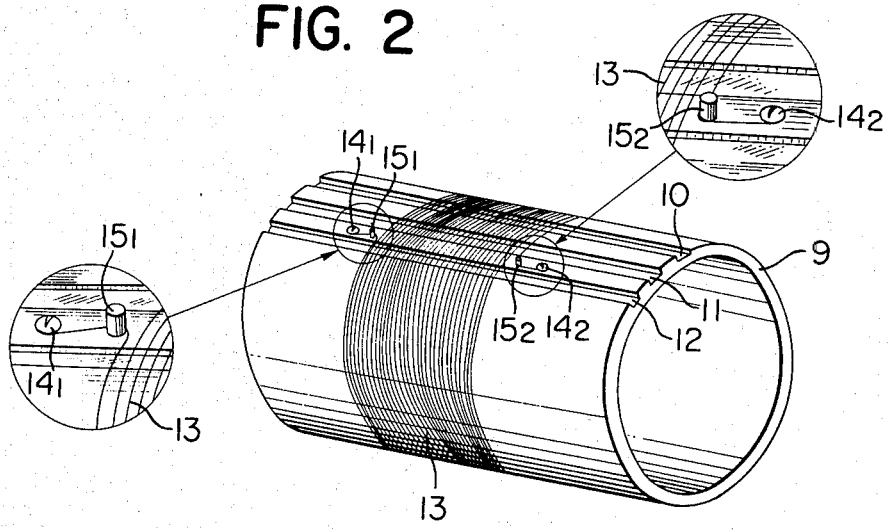
FIG. 2 is a perspective view showing a method of forming a grid according to the present invention.

FIG. 2 is a perspective view showing the method of forming a grid. In the Figure, a cylindrical member 9 is provided with U-shaped grooves 10, 11 and 12 in the direction of the rotational axis. The diameter of the cylindrical member is selected such that the circumferential length thereof is greater than the length of the grid. An electrically conductive thin wire 13 is wound at a predetermined interval on the cylindrical member 9 with a screw $\mathbf{14}_1$ and a pin $\mathbf{15}_1$ as the starting point and secured to the cylindrical member by a screw $\mathbf{14}_2$ through a pin $\mathbf{15}_2$. Material such as tungsten or stainless steel having excellent corrosion resistance and great mechanical strength is suitable as the conductive thin wire 13 and the thickness or diameter of the thin wire is variable by the density, size and other factor of the grid but a wire having a diameter of the order of 50 to 200 microns is usually used. The density of the thin wire of the grid is usually of the order of 0.5 to 4 lines/mm. The interval of the grid is not limited to equal intervals but the density may sometimes be progressively increased to increase the efficiency during the discharging.

Winding the electrically conductive thin wire at the above-described interval on the cylindrical member 1 may be accomplished by a method of rotating the cylindrical member 9 at a predetermined velocity and axially displacing at a predetermined velocity the position from which the conductive thin wire is paid away, or a method of moving the cylindrical member 9 at a predetermined velocity in the direction of the rotational axis while fixing the position from which the thin wire is paid away, or a method of forming a shallow V-shaped groove spirally on the cylindrical member at a position whereat the thin wire is to be wound and winding the wire along such groove. During the winding, a substantially constant tension is exerted on the thin wire. The end of the conductive wire 13 so wound on the cylindrical member is then secured thereto by means of a screw, whereafter hardenable fixing material such as rubber or resin is placed or poured into the grooves 10 and 12 and the conductive thin wire 13 is fixed while maintained at predetermined intervals. Applying a parting agent such as silicon oil or the like to the grooves 10 and 12 in advance is convenient for removing from the cylindrical member the fixing material by which the grid has been fixed, and depending on the rubber or resin used, the conductive thin wire may be subjected to a primer treatment to increase the strength of adhesion. As the rubber used, urethane rubber is excellent from the viewpoint of strength, but chloroprene rubber, ethylene propylene rubber or nitrile rubber is also suitable. As a merit of so using an elastic material as the means for supporting the thin wire 13, it may be mentioned that the irregularity of the tension in each wire of the grid can be absorbed when the grid is mounted on a corona discharger. The configuration of the grooves 10 and 12 is variable with the strength of the thin wire and of the material such as rubber or resin, but a width of several millimeters to ten and several millimeters and a depth of several millimeters will suffice. Of course, the cross-sectional shape of the grooves is not limited to U-shape. To permit rubber or resin to be used as the fixing means for the grid, it is necessary to form the fixing means so as to cover not only the interior of the grooves 10 and 12 but also the top portion of the conductive thin wire 13 in order to positively support the grid. Therefore, when a fixing material having a high fluidity before hardening is used, it is effective to form a wall portion of a weir or the like or to cover the fixing material with a cope having an inlet and maintain the shape thereof until said material hardens.

When the conductive thin wire 13 is cut along the groove 11 after the placed or poured rubber or resin hardens, there is obtained a grid having the opposite ends thereof fixed by the fixing material. Note that the circumferential length of the groove 11 may be selected to a great value and the width of the rubber or resin may be formed to a relatively great width and the circumferentially central portion of such rubber or resin may be cut axially.

Figure 3:
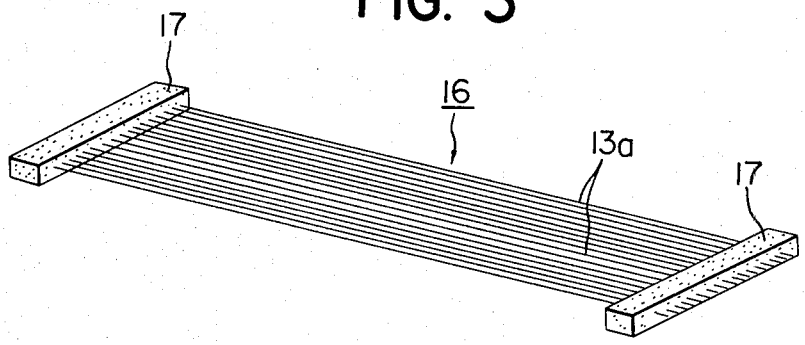
FIG. 3 is a perspective view of the grid formed by the method of FIG. 2.

FIG. 3 is a perspective view of the grid 16 formed in the described manner. In the Figure, reference numeral 17 designates the fixing members each of which is formed of rubber or resin removed from the grooves after hardening. The individual wires 13*a* of the grid thus formed have little irregularity in the interval therebetween and the tension in the wires between the fixing members 17 is substantially constant. Therefore, if this grid is mounted on a corona discharger, there is an advantage that irregularity in the discharging and charging potentials is reduced during the discharging and charging. It is also possible to form a grid with any desired interval by changing the velocity in the direction of the rotational axis during the pay-away of the conductive thin wire when wound and the interval between the grooves provided circumferentially of the cylindrical member. In the embodiment of FIG. 2, a cylindrical member has been shown as being used as the means for winding a conductive thin wire at a predetermined interval, whereas the means for winding the thin wire is not restricted to a cylindrical member but may be a square pillar or a planar member or frame, on which the conductive thin wire may be wound to form a grid.

As the means for fixing the adjacent conductive thin wires with one another after holding then at predetermined intervals in the described manner, other means such as soldering, brazing, welding or various adhesives may be widely used besides the fixing by rubber or resin.

Figure 1:
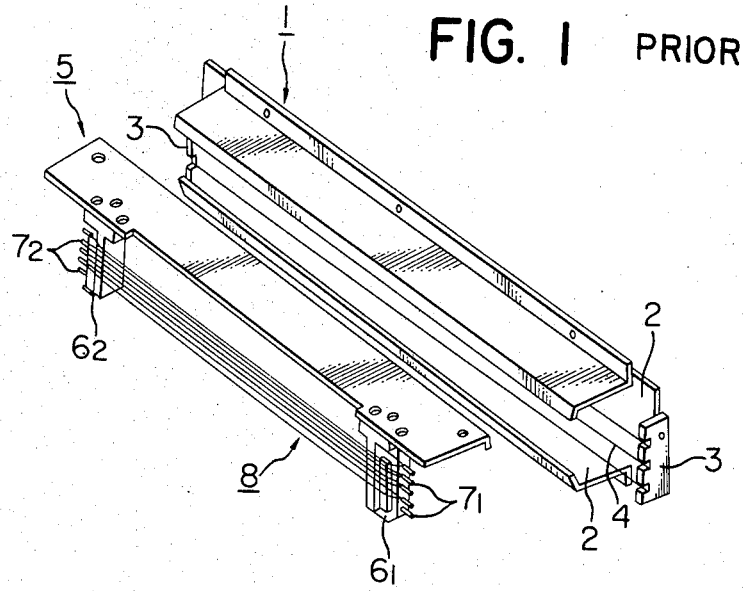
FIG. 1 PRIOR ART
FIG. 1 is an exploded perspective view of a corona discharger having a conventional grid.

Of course, in these cases, a fixing metallic member, for example, may be placed instead of the grooves shown in FIG. 2 and electrically conductive thin wire may be fixed to such metallic member by the aforementioned means to thereby form a grid. From the viewpoint that each individual wire of the grid is electrically continued, it is possible to stretch the individual conductive thin wires by alternately hooking them to pins in the manner as shown in FIG. 1, thereafter fixing the opposite ends thereof by fixing members and thereby form a grid, but using the above-described method is preferable in the case of formation and in the degree of irregularity of the tension exerted on the respective thin wires.

Figure 4:
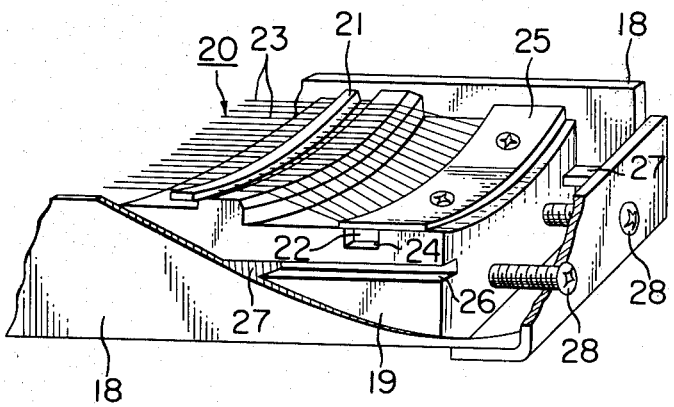
FIGS. 4 and 5 are fragmentary perspective views of a corona discharger having mounted thereon the grid according to the present invention.

FIG. 4 shows, in partly broken-away perspective view, an embodiment in which the grid formed in the shape as shown in FIG. 3 is mounted on a corona discharger. In the Figure, a shield case 18 and an insulating block 19 formed of resin are those widely used with a corona discharger and in order to provide a constant distance between the peripheral surface of a drum-shaped photosensitive medium and the grid 20, the surface of the insulating block on which the grid is stretched is provided with a curvature corresponding to the curvature of the photosensitive medium surface. Although the corona discharge electrode is not shown generally, it is suspended lengthwisely through the insulating block 19. The stretching at the end of this corona discharge electrode may be accomplished arbitrarily and the corona discharge electrode may be stretched between removable insulating members discrete from the insulating block 19. The electrically conductive thin wires 23 forming the grid 20 have their intervals maintained by a rubber-like interval holding member 21. This interval holding member 21 may be formed by providing a further groove outwardly of the fixing member grooves 10 and 12 during the formation of the grid shown in FIG. 2, and pouring hardenable rubber or resin into such groove. The fixing member 22 corresponding to reference character 17 in FIG. 3 is fitted in a groove 24 formed in the insulating block 19 and fixed by a keep plate 25. The conductive thin wires 23 are not continuous to each other at this time, and therefore, in order that the grid may be used while being grounded or subjected to a bias, the keep plate 25 is formed as a metal plate and constructed so that it contacts all the conductive thin wires as shown. Also, a biasing electrode may be provided on other portion which contacts the conductive thin wires and the fixing member 22 may be formed of an electrically conductive material such as, for example, electrically conductive rubber or plastics so as to supply a bias. When the force of adhesion between the fixing member 22 and the conductive thin wires 14 is not sufficient for the tension required, the conductive thin wires 23 may be wound on the fixing member 22 through half turn to several turns, and then fitted into the grooves.

In the drawing, the grid 20 is formed into a cylindrical surface shape along the insulating block 19. Where the image-bearing member such as a photosensitive medium bearing an electrostatic latent image thereon is in a form of drum, this is very effective in that the distance between the image-bearing member surface and the grid can be maintained close over a long range and thus the discharging and charging can be effected uniformly. At this time, if the interval holding member 21 is provided inside of the fixing member 22 of the grid, as already described, the interval between the adjacent grids and the lengthwise width of the grid may be maintained at substantially constant values without being disturbed. Where the image-bearing member surface is planar or where so high accuracy is not required, the grid may be installed in a planar form. Even in such case, the grid interval and the grid width after assembled to the corona discharger may always be effectively maintained by providing the interval holding member 21. Also, as is apparent from the drawing, the interval holding member 21 is so constructed as not to touch the insulating block 19. Further, the groove 26 provided in the insulating block 19 is in mesh engagement with the convex rail 27 of the shield case 18 and the insulating block 19 is free to move lengthwise along this rail 27. Accordingly, by rotating a screw 28 attached to the insulating block 19 and thereby moving the insulating block rightwardly as viewed in the drawing, a sufficient tension may be imparted to the grid. A suitable tension normally imparted is 50 to 1000 g per line of conductive thin wire. The insulating block which secures the other end of the grid on the opposite side from the shield case 18 is secured to the shield case 18. Of course, this insulating block may be constructed slidably like the above-mentioned one. In same cases, irregularity of tension may be caused to each thin wire of the grid, but such irregularity of tension may also be absorbed by using rubber or elastic resin for the fixing member 22. Also, as shown in FIG. 4, the grid unit is detachable with respect to the corona discharger and so, stains such as toner particles deposited on the thin wires of the grid may be easily removed therefrom by detaching the grid unit from the corona discharger.

As described above in detail, according to the present invention, an electrically conductive thin wire is wound at predetermined intervals on a circular cylindrical or a square pillar-like winding member while a constant tension is imparted thereto and the portions of the thin wire corresponding to the opposite ends thereof are fixed by fixing members formed of rubber, resin or metal plate, whereafter the thin wire stretched is cut perpendicularly thereto to form a grid. Therefore, even when a number of grids provided by narrowing the interval between adjacent thin wires is to be stretched, the stretching has become much easier than the conventional method. Also, the stretching has become possible with the irregularity of the interval between adjacent thin wires and the irregularity of the tension in each thin wire being reduced. Further, the grid formed in the above-described manner has become free of the inconvenience that even if only one thin wire is broken, all the thin wires must be replaced as is done in case of the conventional grid which comprises a single wire, and the cleaning of the grid has become easier. Further, if an interval holding member is provided inside of the fixing member of the grid in the manner as described, the interval between adjacent thin wires of the grid and the lengthwise width of the thin wires of the grid can be maintained substantially at predetermined values even when the grid is mounted on a corona discharger. Particularly, where rubber or elastic resin is used for the fixing member for fixing the opposite ends of the grid, it has become possible to absorb the irregularity of the tension in each thin wire and obtain substantially uniform tensioned state of the thin wires.

The following is a preferred example of how a corona discharger having a grid in which the interval between adjacent grid thin wires is narrow and dense is disposed with respect to an image-bearing member. A positioning surface is provided to a member for stretching and holding a control grid and such positioning surface is caused to bear against a discharger receiving member provided in an image formation apparatus, whereby a corona discharger is mounted in the image formation apparatus so that the interval between the control grid and the image-bearing member is always constant.

Accordingly, even in the case where the control grid is as close as about 1 mm to the surface of the image-bearing member to fully achieve the effect of uniforming the surface potential possessed by the control grid, it may be prevented that the control grid becomes too far from the surface of the image-bearing member each time mounting and dismounting is repeated or that the control grid becomes so close to the surface of the image-bearing member that it contacts the latter and thereby the control grid or the surface of the image-bearing surface is injured or toner stain is created on the control grid and thus, stable control of the surface potential is ensured.

Also, according to the present invention, a pair of disjointable slidable cleaning members for holding the control grid therebetween from above and below is provided and each of these slidable cleaning members comprises a control grid cleaning portion and an engaging portion which engages a guide rail provided on the casing of the corona discharger and the cleaning of the control grid is effected by moving this pair of slidable cleaning members lengthwise of the control grid. Consequently, the control grid may always be maintained in a clean state and replacement of the slidable cleaning members may be accomplished very easily.

An embodiment of the present invention will now be described in detail by reference to the drawings.

Figure 5:
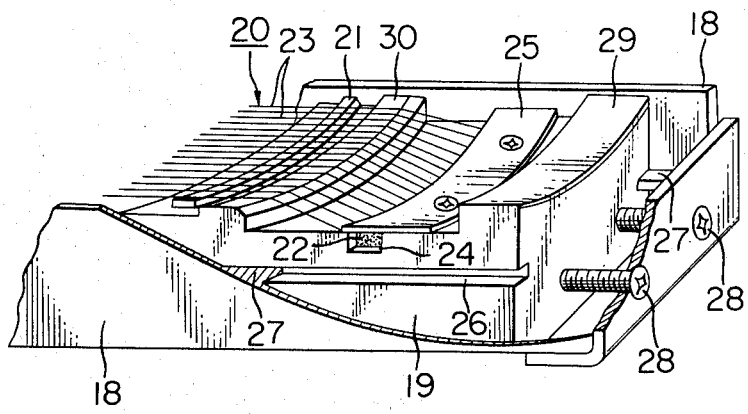

The corona discharger shown in FIG. 3 is one partly contrived on the basis of the discharger of FIG. 4. Designated by 29 is a positioning surface used to mount the corona discharged on the apparatus body. The positioning surface 29 is formed as a cylindrical surface concentric with a surface 30 which positions the grid 20. Since the positioning surface 29 is wrought on the insulating block 19 common to the grid positioning surface 30, the distance relation between the grid and the image-bearing member surface may be easily made highly accurate. In the discharger of FIG. 5, those parts identical in construction and purpose to the parts of the discharger of FIG. 4 are given identical reference numerals and need not be described in detail.

Figure 6:
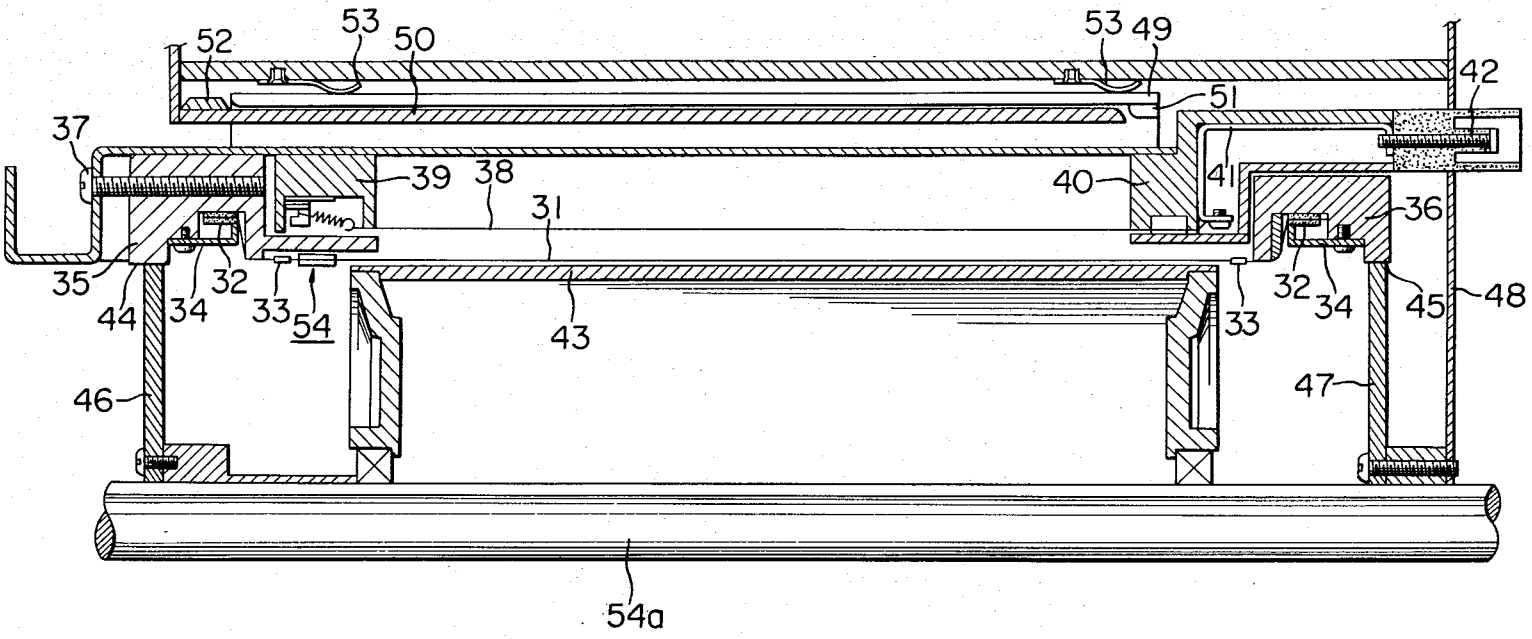
FIG. 6 is a longitudinal cross-sectional view of an image formation apparatus having mounted therein the corona discharger device as shown in FIG. 5.

FIG. 6 is a longitudinal cross-sectional view of an image formation apparatus on which is mounted the corona discharger device having the grid as shown in FIG. 5.

In FIG. 6, the grid 31 is coupled to fixing members 32 at the opposite ends thereof by means of fixing members 33 for maintaining an interval, and the fixing members 32 are fixedly held to insulating blocks 35 and 36 for stretching and holding the grid by keep plates 34. Designated by 37 is a screw for applying a tension to the grid and by turning this screw, the insulating block 35 slidably mounted on the shield of the discharger device is pulled to impart a tension to the grid. A corona discharge electrode 38 is stretched between insulating blocks 39 and 40 for supporting the corona discharge electrode. The corona discharge electrode 38 is connected to a pin plug 42 through a metal plate 41. The pin plug 42 is coupled to an unshown connector and receives voltage supply from a high voltage supply source. Although not shown, the grid 31 is likewise connected to a bias voltage source. The distance of the grid 31 from a recording drum 43 is accurately realized by positioning surfaces 44 and 45 provided on the insulating blocks 35 and 36 bearing against discharger receiving members 46 and 47 when the corona discharger device is inserted into the image formation apparatus from the left as viewed in FIG. 6. The discharger receiving member 47 is secured to the side plate 48 of the image formation apparatus in the case of the present embodiment, and the discharger receiving member 46 is likewise secured to the image formation apparatus. The bearing surfaces of the discharger receiving members 46 and 47 are formed into cylindrical surfaces concentric with the circular peripheral surface of the recording drum 43.

Mounting and dismounting of the corona discharger is effected by means of a rail 49 on the corona discharger side and a guide rail 50 on the copying apparatus side, and during the mounting and dismounting, the action of projected portions 51 and 52 prevents the insulating blocks 35 and 36 from striking against the discharger receiving members 46 and 47 or from contacting the recording drum to injure the same. Where the corona discharger device is installed right above the recording drum, the positioning surface may bear against the discharger receiving members due to gravity, but where the corona discharger device is installed at other position than the said position, the positioning surface may be urged against the receiving members by the action of a spring 53. Of course, when the corona discharger device is positioned right above the recording drum 43 as shown in FIG. 6, urging the positioning surface is also very effective in reliably holding an accurate interval between the grid and the recording drum. Since the positioning surfaces 44, 45 and the discharger receiving members 46, 47 are all on concentric circular planes centered at the supporting shaft 54*a* of the recording drum 43, the opposite ends of the corona discharger device are deviated from each other in the opposite directions to thereby enable then to positively bear against the discharger receiving members and maintain a constant interval between the grid 31 and the recording drum 43 even when the corona discharger device is somewhat distorted in the opposite direction in its lengthwise end portion so that the corona discharger device does not completely bear against the discharger receiving member.

Reference character 54 designates a cleaning device for cleaning the grid and the details thereof will now be described by reference to FIG. 7.

Figure 7:
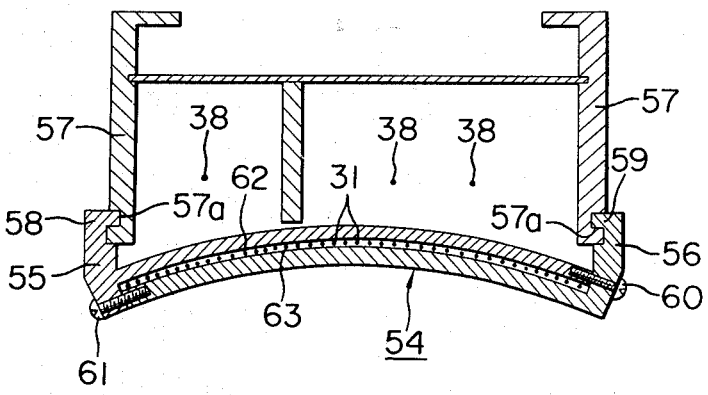
FIG. 7 is a transverse cross-sectional view of a corona discharger device having a cleaning device.

FIG. 7 is a transverse cross-sectional view of the corona discharger device having the cleaning device. The cleaning device 54 comprises a pair of slidable cleaning members 55 and 56. Engaging portions 58 and 59 engaging guide rails 57*a* provided on the shield 57 of he corona discharger device are provided at one end of the slidable cleaning members 55 and 56, and these slidable cleaning members are movable lengthwise of the discharger device. The slidable cleaning members 55 and 56 hold the grid 31 therebetween from above and below and are joined together by screws 60 and 61. On that side of the slidable cleaning members 55 and 56 which faces the grid, there are provided cleaning portions 62 and 63 having attached thereto a cleaning material comprising, for example, foamed rubber or felt, and by manually grasping the slidable cleaning members 55 and 56 and moving it along the shield plates 57, the cleaning of the grid may be carried out. Of course, various modifications are possible including the provision of a handle on the slidable cleaning members so that the cleaning members may be slidden by means of the handle.

According to the present embodiment, the grid can always be kept clean and the slidable cleaning members 55 and 56 may be simply separated and removed by removing the screws 60 and 61, and replacement of the cleaning members may be easily effected even with the grid remaining mounted.

The present invention can always maintain a constant interval between the control grid and the image-bearing member by the above-described construction and ensures stable potential control of the surface of the image-bearing member.

Also, by providing a pair of slidable cleaning members holding the control grid therebetween, the stain on the grid may be removed to prevent charging irregularity or like evils and replacement of the cleaning members may be accomplished very simply.

What I claim is:

1. A corona discharger for applying corona discharge onto an image bearing member comprising:

a corona discharge electrode;

a shield member, having a discharge opening, for partially surrounding the electrode;

a grid including a pair of fixing members and a number of fine conductive wires, wherein said fixing members include means for clasping and holding the opposite ends of said conductive wires;

an insulating support member for stretching and supporting said grid;

means for locking said fixing members to said insulating support member; and means for applying tension to the grid wires.

2. A corona discharger for applying corona discharge onto an image bearing member comprising:

a corona discharge electrode;

a shield member, having a discharge opening, for partially surrounding the electrode;

a grid including a pair of fixing members and a number of fine conductive wires, wherein said fixing members include means for clasping and holding the opposite ends of said conductive wires;

a supporting member for stretching and supporting said grid; and means for locking said fixing members to said supporting member;

wherein said supporting member has a surface for positioning said grid.

3. A corona discharger for applying corona discharge onto an image bearing member comprising:

a corona discharge electrode;

a shield member, having a discharge opening, for partially surrounding the electrode;

a grid including a pair of fixing members and a number of fine conductive wires, wherein said fixing members include means for clasping and holding the opposite ends of said conductive wires;

an insulating supporting member for stretching and supporting said grid; and means for locking said fixing members to said insulating support member.

4. A discharger according to claim 1, 2 or 3, wherein said locking means includes a confining plate and a groove provided in said support member, and where said fixing member is placed in the groove and confined by said confining plate.

5. A discharger according to claim 4, wherein said fixing member is conductive for being maintained at a predetermined potential level.

6. A discharger according to claim 4, wherein said confining plate is conductive and is in electrical contact with the wires of said grid for maintaining said grid at a predetermined potential level.

7. A discharger according to claim 1, further comprising rotating screw means, wherein said insulating support member is slidable in response to rotation of said screw means, and wherein the wires of the grid are maintained under tension by rotating said screw means.

8. A discharger according to claim 4, further comprising rotating screw means, wherein said support member is slidable in response to rotation of said screw means, and wherein the wires of the grid are maintained under tension by rotating said screw means.

9. A discharger according to claim 1, 2 or 3 wherein the wires of said grid are disposed at regular intervals.

10. A discharger according to claim 1, 2 or 3 wherein the wires of said grid are disposed at irregular intervals.

11. A discharger according to claim 1, 2 or 3 wherein said grid includes spacing means for spacing the adjacent wires.

12. A discharger according to claim 9, wherein said grid includes spacing means for spacing the adjacent wires.

13. A discharger according to claim 10, wherein said grid includes spacing means for spacing the adjacent wires.

14. A discharger according to claim 1 2 or 3 wherein said grid is formed by winding wires on a pillar-like winding member.

15. A discharger according to claim 9, wherein said grid is formed by winding wires on a pillar-like winding member.

16. A discharger according to claim 10, wherein said grid is formed by winding wires on a pillar-like winding member.

17. A discharger according to claim 2, wherein said positioning surface is a curved surface.

18. A discharger according to claim 17, wherein said curved surface is arcuate in conformance with a curved surface upon which corona is to be applied by said corona electrode.

19. A corona discharger according to claim 1, 2 or 3, usable with an image forming apparatus, wherein said supporting member has a positioning surface for maintaining a predetermined clearance between said grid and the image bearing member, the positioning surface being adapted to be employed with a discharge receiving member of the image forming apparatus.

20. A discharger according to claim 1, 2 or 3 further comprising means mounted for cleaning the wires of the grid.

21. A discharger according to claim 20, wherein said cleaning means includes a pair of detachable cleaning members cooperatively disposed on opposed sides of said grid for movement to clean said wires.

22. A corona discharger according to claim 19, wherein the image bearing member is of a drum shape; said positioning surface is concentric with the surface of the drum shaped image bearing member; and, said discharger receiving member is coaxial with the image bearing member.

* * * * *